US009662766B2

(12) United States Patent
Schwabel et al.

(10) Patent No.: US 9,662,766 B2
(45) Date of Patent: May 30, 2017

(54) METHOD OF ABRADING A WORKPIECE

(75) Inventors: Mark G. Schwabel, Lake Elmo, MN (US); Josef Kofler, Treffnerstrasse (AT)

(73) Assignee: 3M Innovative Properties Company, St. Paul, MN (US)

( * ) Notice: Subject to any disclaimer, the term of this patent is extended or adjusted under 35 U.S.C. 154(b) by 60 days.

(21) Appl. No.: 14/343,237

(22) PCT Filed: Aug. 28, 2012

(86) PCT No.: PCT/US2012/052677

§ 371 (c)(1),
(2), (4) Date: May 30, 2014

(87) PCT Pub. No.: WO2013/036402

PCT Pub. Date: Mar. 14, 2013

(65) Prior Publication Data

US 2014/0287654 A1 Sep. 25, 2014

Related U.S. Application Data

(60) Provisional application No. 61/531,668, filed on Sep. 7, 2011.

(51) Int. Cl.
*B24D 5/12* (2006.01)
*B24D 18/00* (2006.01)
(Continued)

(52) U.S. Cl.
CPC ..... *B24D 5/12* (2013.01); *B24B 27/0675* (2013.01); *B24D 3/20* (2013.01); *B24D 3/344* (2013.01)

(58) Field of Classification Search
CPC ... B24D 5/12; B24D 5/02; B24D 3/00; B24D 18/00; B24D 5/06; C09K 5/06
(Continued)

(56) References Cited

U.S. PATENT DOCUMENTS 1,910,444 A 5/1933 Nicholson
3,041,156 A 6/1962 Rowse
(Continued)

FOREIGN PATENT DOCUMENTS

CN 1055689 A 10/1991
CN 1138839 A 12/1996
(Continued)

OTHER PUBLICATIONS

Lindsay, "The Effect of Contact Time on Forces, Wheelwear Rate and G-Ratio During Internal and External Grinding", Annals of the CIRP, 1984, vol. 33, No. 1, pp. 193-197.
(Continued)

*Primary Examiner* — Robert Rose
(74) *Attorney, Agent, or Firm* — Bradford B. Wright

(57) ABSTRACT

A method of abrading a workpiece includes: contacting a metallic workpiece, having a bulk temperature of less than 500 degrees Celsius, with a stationary rotating bonded abrasive wheel having a diameter of at least 150 millimeters, wherein the bonded abrasive wheel comprises ceramic shaped abrasive particles retained in a binder, and wherein metallic swarf is formed, and at least 20 percent by weight of the metallic swarf is filamentary metallic swarf having a length of at least 3 mm.

11 Claims, 3 Drawing Sheets

(51) Int. Cl.
*B24B 27/06* (2006.01)
*B24D 3/20* (2006.01)
*B24D 3/34* (2006.01)

(58) Field of Classification Search
USPC ..... 451/546, 541, 544, 28; 51/307, 309, 298
See application file for complete search history.

(56) References Cited

U.S. PATENT DOCUMENTS

| | | | | |
|---|---|---|---|---|
| 4,314,827 | A | 2/1982 | Leitheiser | |
| 4,623,364 | A | 11/1986 | Cottringer | |
| 4,652,275 | A | 3/1987 | Bloecher | |
| 4,744,802 | A | 5/1988 | Schwabel | |
| 4,770,671 | A | 9/1988 | Monroe | |
| 4,799,939 | A | 1/1989 | Bloecher | |
| 4,881,951 | A | 11/1989 | Wood | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,085,671 | A | 2/1992 | Martin | |
| 5,152,917 | A | 10/1992 | Pieper | |
| 5,164,348 | A | 11/1992 | Wood | |
| 5,213,591 | A | 5/1993 | Celikkaya | |
| 5,282,875 | A | 2/1994 | Wood | |
| 5,352,254 | A | 10/1994 | Celikkaya | |
| 5,435,816 | A | 7/1995 | Spurgeon | |
| 5,500,273 | A * | 3/1996 | Holmes et al. | 428/147 |
| 5,551,963 | A | 9/1996 | Larmie | |
| 5,645,619 | A | 7/1997 | Erickson | |
| 5,672,097 | A | 9/1997 | Hoopman | |
| 5,695,394 | A * | 12/1997 | Buffat et al. | 451/546 |
| 5,876,470 | A * | 3/1999 | Abrahamson | 51/309 |
| 5,946,991 | A | 9/1999 | Hoopman | |
| 5,975,987 | A | 11/1999 | Hoopman | |
| 6,129,540 | A | 10/2000 | Hoopman | |
| 6,277,161 | B1 | 8/2001 | Castro | |
| 6,620,214 | B2 | 9/2003 | McArdle | |
| 8,034,137 | B2 | 10/2011 | Erickson | |
| 8,123,828 | B2 | 2/2012 | Culler | |
| 8,142,531 | B2 | 3/2012 | Adefris | |
| 8,142,532 | B2 | 3/2012 | Erickson | |
| 8,142,891 | B2 | 3/2012 | Culler | |
| 8,480,772 | B2 | 7/2013 | Welygan | |
| 8,551,577 | B2 | 10/2013 | Moren | |
| 2001/0005664 | A1 | 6/2001 | Miura et al. | |
| 2002/0026752 | A1 | 3/2002 | Culler | |
| 2004/0148967 | A1 * | 8/2004 | Celikkaya et al. | 65/21.2 |
| 2006/0211342 | A1 | 9/2006 | Bonner et al. | |
| 2008/0155904 | A1 | 7/2008 | Peterson | |
| 2009/0165394 | A1 | 7/2009 | Culler | |
| 2009/0169816 | A1 | 7/2009 | Erickson | |
| 2010/0146867 | A1 | 6/2010 | Boden | |
| 2010/0159806 | A1 | 6/2010 | Wu | |
| 2010/0319269 | A1 | 12/2010 | Erickson | |
| 2012/0149289 | A1 * | 6/2012 | Lee et al. | 451/541 |
| 2013/0040537 | A1 | 2/2013 | Schwabel | |
| 2013/0203328 | A1 * | 8/2013 | Givot et al. | 451/548 |

FOREIGN PATENT DOCUMENTS

| | | | |
|---|---|---|---|
| CN | 1301615 | A | 7/2001 |
| CN | 1348404 | A | 5/2002 |
| CN | 1646261 | A | 7/2005 |
| CN | 101277789 | A | 1/2008 |
| CN | 101124066 | A | 2/2008 |
| CN | 101909823 | A | 12/2010 |
| JP | 07-509508 | | 10/1995 |
| RU | 2004102898 | A | 6/2005 |
| WO | WO 94/02559 | | 2/1994 |
| WO | WO 95/19242 | | 7/1995 |
| WO | WO 00-64633 | A2 | 11/2000 |
| WO | WO 2006/069179 | A2 | 6/2006 |
| WO | WO 2007041538 | A1 | 4/2007 |
| WO | WO 2011-068714 | | 6/2011 |
| WO | WO 2011-068724 | | 6/2011 |
| WO | WO 2011-109188 | | 9/2011 |
| WO | WO 2011-139562 | | 11/2011 |
| WO | WO 2012-018903 | | 2/2012 |
| WO | WO 2012-061016 | | 5/2012 |
| WO | WO 2012-061033 | | 5/2012 |
| WO | WO 2012-112305 | | 8/2012 |
| WO | WO 2012-112322 | | 8/2012 |
| WO | WO 2012-141905 | | 10/2012 |
| WO | WO 2013-009484 | | 1/2013 |
| WO | WO 2013-045251 | | 4/2013 |
| WO | WO 2013-070576 | | 5/2013 |
| WO | WO 2014/070468 | | 5/2014 |

OTHER PUBLICATIONS

International Search Report for PCT International Application No. PCT/US2012/052677 Mailed on Dec. 20, 2012, 4 pages.

* cited by examiner

METHOD OF ABRADING A WORKPIECE

FIELD

The present application relates to methods of abrading a workpiece using a bonded abrasive wheel.

BACKGROUND

Bonded abrasive articles have abrasive particles bonded together by a bonding medium. Bonded abrasives include, for example, stones, hones, grinding wheels, and cut-off wheels. The bonding medium is typically an organic resin, but may also be an inorganic material such as a ceramic or glass (i.e., vitreous bonds).

Cut-off wheels are typically thin wheels used for general cutting operations. The wheels are typically about 20 to about 2500 millimeter in diameter, and from less than one millimeter (mm) to about 16 mm thick. Typically, the thickness is about one percent of the diameter. They are typically operated at speeds of from about 35 msec to 100 msec, and are used for operations such as cutting metal or stone; for example, to a nominal length. Cut-off wheels are also known as "abrasive cut-off saw blades" and, in some settings such as foundries, as "chop saws". As their name implies, cut-off wheels are commonly used to cut stock (i.e., a workpiece) such as, for example, metal rods, by abrading through the stock.

Cut-off wheels can be used in dry cutting, wet-cutting, cold-cutting, and hot-cutting applications. During cutting heat generated by friction may cause physical changes in the material being cut; for example, carbon steel may develop a bluish color that may be undesirable for mechanical (e.g., blue brittleness) and/or aesthetic reasons.

When evaluating the cutting performance of abrasive wheels (e.g., grinding wheels and cut-off wheels), a ratio known as the G-ratio is commonly used. The G-ratio has been variously defined as: the grams of stock removed divided by the grams of wheel lost, volume of stock removed divided by the volume of wheel lost, and as the cross-sectional area of the cut formed in the stock divided by the area on the round side of the cut-off wheel that is lost. As used herein, the term "G-ratio" refers only to the latter definition (i.e., the cross-sectional area of the cut formed in the stock divided by the area on the round side of the cut-off wheel that is lost).

SUMMARY

Unexpectedly, the present inventors have found that bonded abrasives containing ceramic shaped abrasive particles retained in a binder can be formed into wheels that have an abrading (e.g., cutting) mode unlike that of conventional crushed grain bonded abrasive wheels. When using such cut-off wheel s under appropriate conditions, filamentary swarf is generated along with a large shower of especially bright sparks and spark trails that is substantially larger than that seen with conventional crushed abrasive grain cut-off wheels having the same abrasive composition (e.g., alpha alumina). Moreover, under cold cutting conditions, no bluing of steel is observed.

In one aspect, the present disclosure provides a method of abrading a workpiece, the method comprising:

providing a stationary rotating bonded abrasive wheel having a diameter of at least 150 millimeters, wherein the bonded abrasive wheel comprises ceramic shaped abrasive particles retained in a binder; and contacting the rotating bonded abrasive wheel with a metallic workpiece such that the workpiece is abraded with simultaneous formation of metallic swarf, wherein the metallic workpiece has a bulk temperature of less than 500° C., and wherein at least 20 percent by weight of the metallic swarf is filamentary metallic swarf having a length of at least 3 millimeters (mm).

In methods according to the present disclosure, the metallic workpiece has a bulk temperature of less than 500° C., in some embodiments less than 300° C., less than 100° C., or even less than 50° C. As used herein, the term "bulk temperature" refers to the temperature of the workpiece at a location sufficiently distant from the site of abrading/cutting that it is substantially unaffected by heating that occurs due to abrading/cutting.

In some embodiments, on a weight basis, at least 20 percent, 30 percent, 40 percent, 50 percent, or even at least 60 percent of the metallic swarf is filamentary. Filamentary metallic swarf may have a length of at least 3 millimeters (mm), at least 10 mm, at least 15 mm, at least 20 mm, or even at least 25 mm. In some embodiments, at least a portion of the filamentary swarf may have an aspect ratio (length divided by width) of at least 5, 10, 20, 50, or even 100. Advantageously, methods according to the present disclosure can achieve at least one of the following benefits over conventional bonded abrasive wheels: a) higher abrading rate at a given temperature, and b) lower temperature at a given abrading rate, resulting in increased service life of the tool.

The features and advantages of the present disclosure will be further understood upon consideration of the detailed description as well as the appended claims.

BRIEF DESCRIPTION OF THE DRAWINGS

While the above-identified drawing figures set forth several embodiments of the present disclosure, other embodiments are also contemplated, as noted in the discussion. The figures may not be drawn to scale. Like reference numbers may have been used throughout the figures to denote like parts.

DETAILED DESCRIPTION

Methods of abrading according to the present disclosure utilize bonded abrasive cut-off wheels that include ceramic shaped abrasive particles.

Figure 1:
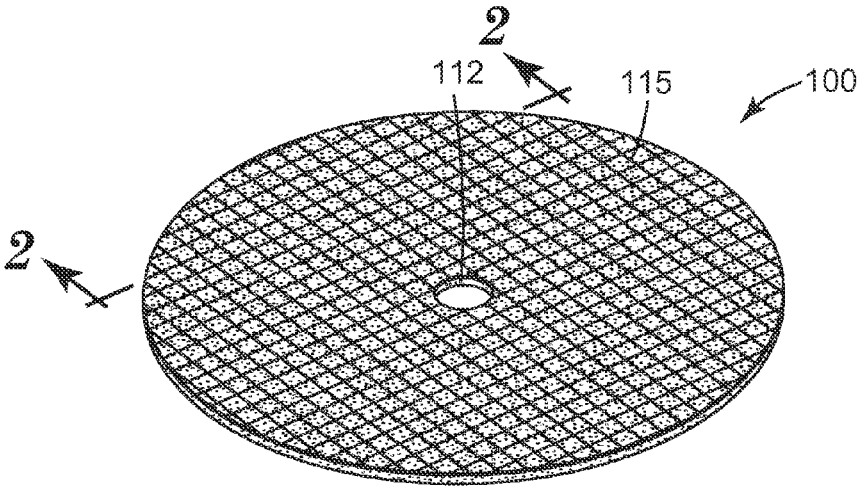
FIG. 1 is a perspective view of an exemplary bonded abrasive cut-off wheel useful in practice of the present disclosure.

Referring now to FIG. 1, exemplary bonded abrasive cut-off wheel 100 useful for practicing methods of the present disclosure has center hole 112 used for attaching cut-off wheel 100 to, for example, a power driven tool.

Cut-off wheel 100 includes ceramic shaped abrasive particles 20, optional conventionally crushed and sized abrasive particles 30, and binder 25.

Figure 2:
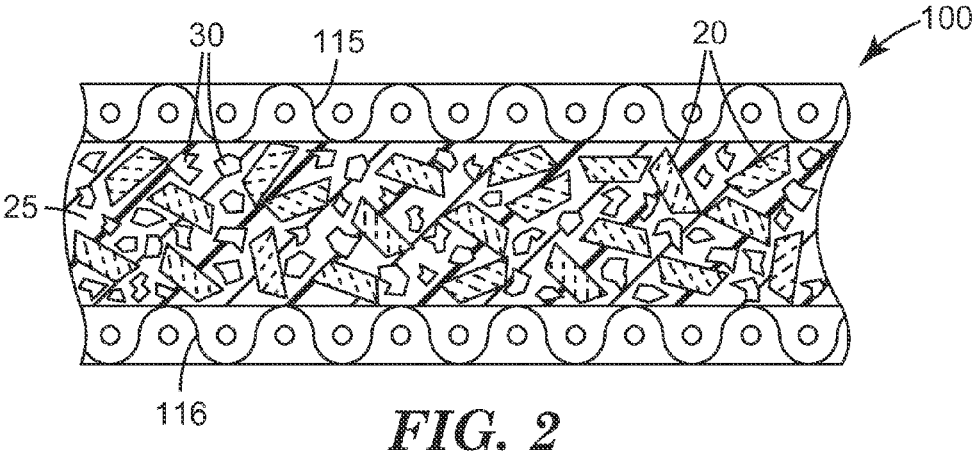
FIG. 2 is a cross-sectional side view of the exemplary bonded abrasive cut-off wheel shown in FIG. 1 taken along line 2-2.

FIG. 2 is a cross-section of cut-off wheel 100 of FIG. 1 taken along line 2-2, showing ceramic shaped abrasive particles 20, optional conventional crushed abrasive particles 30, and binder 25. Cut-off wheel 100 has optional first reinforcing member 115 and optional second reinforcing member 116, which are disposed on opposed major surfaces of cut-off wheel 100. In practice, the orientation of the ceramic shaped abrasive particles may be different than the idealized orientation shown here. Also, one or more internal reinforcing members may also be included.

Bonded abrasive cut-off wheels are generally made by a molding process. During molding, a binder precursor, either liquid organic, powdered inorganic, powdered organic, or a combination of thereof, is mixed with the abrasive particles. In some instances, a liquid medium (either resin or a solvent) is first applied to the abrasive particles to wet their outer surface, and then the wetted particles are mixed with a powdered medium. Bonded abrasive wheels according to the present disclosure may be made by compression molding, injection molding, transfer molding, or the like. The molding can be done either by hot or cold pressing or any suitable manner known to those skilled in the art.

The binder typically comprises a glassy inorganic material (e.g., as in the case of vitrified abrasive wheels), metal, or an organic resin (e.g., as in the case of resin-bonded abrasive wheels).

Glassy inorganic binders may be made from a mixture of different metal oxides. Examples of these metal oxide vitreous binders include silica, alumina, calcia, iron oxide, titania, magnesia, sodium oxide, potassium oxide, lithium oxide, manganese oxide, boron oxide, phosphorous oxide, and the like. Specific examples of vitreous binders based upon weight include, for example, 47.61 percent $SiO_2$, 16.65 percent $Al_2O_3$, 0.38 percent $Fe_2O_3$, 0.35 percent $TiO_2$, 1.58 percent CaO, 0.10 percent MgO, 9.63 percent $Na_2O$, 2.86 percent $K_2O$, 1.77 percent $Li_2O$, 19.03 percent $B_2O_3$, 0.02 percent $MnO_2$, and 0.22 percent $P_2O_5$; and 63 percent $SiO_2$, 12 percent $Al_2O_3$, 1.2 percent CaO, 6.3 percent $Na_2O$, 7.5 percent $K_2O$, and 10 percent $B_2O_3$. During manufacture of a vitreous bonded abrasive wheel, the vitreous binder, in a powder form, may be mixed with a temporary binder, typically an organic binder. The vitrified binders may also be formed from a frit, for example anywhere from about one to 100 percent frit, but generally 20 to 100 percent frit. Some examples of common materials used in frit binders include feldspar, borax, quartz, soda ash, zinc oxide, whiting, antimony trioxide, titanium dioxide, sodium silicofluoride, flint, cryolite, boric acid, and combinations thereof. These materials are usually mixed together as powders, fired to fuse the mixture and then the fused mixture is cooled. The cooled mixture is crushed and screened to a very fine powder to then be used as a frit binder. The temperature at which these frit bonds are matured is dependent upon its chemistry, but may range from anywhere from about 600° C. to about 1800° C.

The binder, which holds the wheel together, is typically included in an amount of from 5 to 50 percent, more typically 10 to 25, and even more typically 12 to 24 percent by weight, based on the total weight of the bonded abrasive wheel.

Examples of metal binders include tin, copper, aluminum, nickel, and combinations thereof.

The binder may comprise a cured organic binder resin, filler, and grinding aids. Phenolic resin is the most commonly used organic binder resin, and may be used in both the powder form and liquid state. Although phenolic resins are widely used, it is within the scope of this disclosure to use other organic binder resins including, for example, epoxy resins, polyimide resins, polyester resins, urea-formaldehyde resins, rubbers, shellacs, and acrylic binders. The organic binder may also be modified with other binders to improve or alter the properties of the binder. The amount of organic binder resin can be, for example, from 15 to 100 percent by weight of the total weight of the binder.

Useful phenolic resins include novolac and resole phenolic resins. Novolac phenolic resins are characterized by being acid-catalyzed and having a ratio of formaldehyde to phenol of less than one, typically between 0.5:1 and 0.8:1. Resole phenolic resins are characterized by being alkaline catalyzed and having a ratio of formaldehyde to phenol of greater than or equal to one, typically from 1:1 to 3:1. Novolac and resole phenolic resins may be chemically modified (e.g., by reaction with epoxy compounds), or they may be unmodified. Exemplary acidic catalysts suitable for curing phenolic resins include sulfuric, hydrochloric, phosphoric, oxalic, and p-toluenesulfonic acids. Alkaline catalysts suitable for curing phenolic resins include sodium hydroxide, barium hydroxide, potassium hydroxide, calcium hydroxide, organic amines, or sodium carbonate.

Phenolic resins are well-known and readily available from commercial sources. Examples of commercially available novolac resins include DUREZ 1364, a two-step, powdered phenolic resin (marketed by Durez Corporation of Addison, Tex., under the trade designation VARCUM (e.g., 29302), or HEXION AD5534 RESIN (marketed by Hexion Specialty Chemicals, Inc. of Louisville, Ky.). Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co. of Bartow, Fla. under the trade designation AEROFENE (e.g., AEROFENE 295); and those marketed by Kangnam Chemical Company Ltd. of Seoul, South Korea under the trade designation "PHENOLITE" (e.g., PHENOLITE TD-2207).

Curing temperatures of organic binder precursors will vary with the material chosen and wheel design. Selection of suitable conditions is within the capability of one of ordinary skill in the art. Exemplary conditions for a phenolic binder may include an applied pressure of about 20 tons per 4 inches diameter (224 kg/cm$^2$) at room temperature followed by heating at temperatures up to about 190° C. for sufficient time to cure the organic binder precursor.

In some embodiments, the bonded abrasive wheels include from about 10 to 80 percent by weight of ceramic shaped abrasive particles; typically 30 to 60 percent by weight, and more typically 40 to 60 percent by weight, based on the total weight of the binder and abrasive particles.

Ceramic shaped abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Patent Appl. Nos. 2009/0165394 A1 (Culler et al.) and 2009/0169816 A1 (Erickson et al.).

Alpha alumina-based ceramic shaped abrasive particles can be made according to a multistep process. Briefly, the method comprises the steps of making either a seeded or non-seeded sol-gel alpha alumina precursor dispersion that can be converted into alpha alumina; filling one or more mold cavities having the desired outer shape of the shaped abrasive particle with the sol-gel, drying the sol-gel to form precursor ceramic shaped abrasive particles; removing the precursor ceramic shaped abrasive particles from the mold cavities; calcining the precursor ceramic shaped abrasive particles to form calcined, precursor ceramic shaped abrasive particles, and then sintering the calcined, precursor ceramic shaped abrasive particles to form ceramic shaped abrasive particles. The process will now be described in greater detail.

The first process step involves providing either a seeded or non-seeded dispersion of an alpha alumina precursor that can be converted into alpha alumina. The alpha alumina precursor dispersion often comprises a liquid that is a volatile component. In one embodiment, the volatile component is water. The dispersion should comprise a sufficient amount of liquid for the viscosity of the dispersion to be sufficiently low to enable filling mold cavities and replicating the mold surfaces, but not so much liquid as to cause subsequent removal of the liquid from the mold cavity to be prohibitively expensive. In one embodiment, the alpha alumina precursor dispersion comprises from 2 percent to 90 percent by weight of the particles that can be converted into alpha alumina, such as particles of aluminum oxide monohydrate (boehmite), and at least 10 percent by weight, or from 50 percent to 70 percent, or 50 percent to 60 percent, by weight of the volatile component such as water. Conversely, the alpha alumina precursor dispersion in some embodiments contains from 30 percent to 50 percent, or 40 percent to 50 percent, by weight solids.

Aluminum oxide hydrates other than boehmite can also be used. Boehmite can be prepared by known techniques or can be obtained commercially. Examples of commercially available boehmite include products having the trade designations "DISPERAL", and "DISPAL", both available from Sasol North America, Inc. of Houston, Tex., or "HiQ-40" available from BASF Corporation of Florham Park, N.J. These aluminum oxide monohydrates are relatively pure; that is, they include relatively little, if any, hydrate phases other than monohydrates, and have a high surface area.

The physical properties of the resulting ceramic shaped abrasive particles will generally depend upon the type of material used in the alpha alumina precursor dispersion. In one embodiment, the alpha alumina precursor dispersion is in a gel state. As used herein, a "gel" is a three dimensional network of solids dispersed in a liquid.

The alpha alumina precursor dispersion may contain a modifying additive or precursor of a modifying additive. The modifying additive can function to enhance some desirable property of the abrasive particles or increase the effectiveness of the subsequent sintering step. Modifying additives or precursors of modifying additives can be in the form of particles, particle suspensions, sols or soluble salts, typically water soluble salts. They typically consist of a metal-containing compound and can be a precursor of oxide of magnesium, zinc, iron, silicon, cobalt, nickel, zirconium, hafnium, chromium, yttrium, praseodymium, samarium, ytterbium, neodymium, lanthanum, gadolinium, cerium, dysprosium, erbium, titanium, zirconium, and mixtures thereof. The particular concentrations of these additives that can be present in the alpha alumina precursor dispersion can be varied based on skill in the art.

Typically, the introduction of a modifying additive or precursor of a modifying additive will cause the alpha alumina precursor dispersion to gel. The alpha alumina precursor dispersion can also be induced to gel by application of heat over a period of time. The alpha alumina precursor dispersion can also contain a nucleating agent (seeding) to enhance the transformation of hydrated or calcined aluminum oxide to alpha alumina. Nucleating agents suitable for this disclosure include fine particles of alpha alumina, alpha ferric oxide or its precursor, titanium oxides and titanates, chrome oxides, or any other material that will nucleate the transformation. The amount of nucleating agent, if used, should be sufficient to effect the transformation of alpha alumina Nucleating such alpha alumina precursor dispersions is disclosed in U.S. Pat. No. 4,744,802 (Schwabel).

A peptizing agent can be added to the alpha alumina precursor dispersion to produce a more stable hydrosol or colloidal alpha alumina precursor dispersion. Suitable peptizing agents are monoprotic acids or acid compounds such as acetic acid, hydrochloric acid, formic acid, and nitric acid. Multiprotic acids can also be used but they can rapidly gel the alpha alumina precursor dispersion, making it difficult to handle or to introduce additional components thereto. Some commercial sources of boehmite contain an acid titer (such as absorbed formic or nitric acid) that will assist in forming a stable alpha alumina precursor dispersion.

The alpha alumina precursor dispersion can be formed by any suitable means, such as, for example, by simply mixing aluminum oxide monohydrate with water containing a peptizing agent or by forming an aluminum oxide monohydrate slurry to which the peptizing agent is added.

Defoamers or other suitable chemicals can be added to reduce the tendency to form bubbles or entrain air while mixing. Additional chemicals such as wetting agents, alcohols, or coupling agents can be added if desired. The alpha alumina abrasive particles may contain silica and iron oxide as disclosed in U.S. Pat. No. 5,645,619 (Erickson et al.). The alpha alumina abrasive particles may contain zirconia as disclosed in U.S. Pat. No. 5,551,963 (Larmie). Alternatively, the alpha alumina abrasive particles can have a microstructure or additives as disclosed in U.S. Pat. No. 6,277,161 (Castro).

The second process step involves providing a mold having at least one mold cavity, and preferably a plurality of cavities. The mold can have a generally planar bottom surface and a plurality of mold cavities. The plurality of cavities can be formed in a production tool. The production tool can be a belt, a sheet, a continuous web, a coating roll such as a rotogravure roll, a sleeve mounted on a coating roll, or die. In one embodiment, the production tool comprises polymeric material. Examples of suitable polymeric materials include thermoplastics such as polyesters, polycarbonates, poly(ether sulfone), poly(methyl methacrylate), polyurethanes, polyvinylchloride, polyolefin, polystyrene, polypropylene, polyethylene or combinations thereof, or thermosetting materials. In one embodiment, the entire tooling is made from a polymeric or thermoplastic material. In another embodiment, the surfaces of the tooling in contact with the sol-gel while drying, such as the surfaces of the plurality of cavities, comprises polymeric or thermoplastic materials and other portions of the tooling can be made from other materials. A suitable polymeric coating may be applied to a metal tooling to change its surface tension properties by way of example.

A polymeric or thermoplastic tool can be replicated off a metal master tool. The master tool will have the inverse pattern desired for the production tool. The master tool can be made in the same manner as the production tool. In one embodiment, the master tool is made out of metal, e.g., nickel and is diamond turned. The polymeric sheet material can be heated along with the master tool such that the polymeric material is embossed with the master tool pattern by pressing the two together. A polymeric or thermoplastic material can also be extruded or cast onto the master tool and then pressed. The thermoplastic material is cooled to solidify and produce the production tool. If a thermoplastic production tool is utilized, then care should be taken not to generate excessive heat that may distort the thermoplastic production tool limiting its life. More information concerning the design and fabrication of production tooling or master tools can be found in U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.).

Access to cavities can be from an opening in the top surface or bottom surface of the mold. In some instances, the cavities can extend for the entire thickness of the mold. Alternatively, the cavities can extend only for a portion of the thickness of the mold. In one embodiment, the top surface is substantially parallel to bottom surface of the mold with the cavities having a substantially uniform depth. At least one side of the mold, that is, the side in which the cavities are formed, can remain exposed to the surrounding atmosphere during the step in which the volatile component is removed.

The cavities have a specified three-dimensional shape to make the ceramic shaped abrasive particles. The depth dimension is equal to the perpendicular distance from the top surface to the lowermost point on the bottom surface. The depth of a given cavity can be uniform or can vary along its length and/or width. The cavities of a given mold can be of the same shape or of different shapes.

The third process step involves filling the cavities in the mold with the alpha alumina precursor dispersion (e.g., by a conventional technique). In some embodiments, a knife roll coater or vacuum slot die coater can be used. A mold release can be used to aid in removing the particles from the mold if desired. Typical mold release agents include oils such as peanut oil or mineral oil, fish oil, silicones, polytetrafluoroethylene, zinc stearate, and graphite. In general, mold release agent such as peanut oil, in a liquid, such as water or alcohol, is applied to the surfaces of the production tooling in contact with the sol-gel such that between about 0.1 mg/in$^2$ (0.02 mg/cm$^2$) to about 3.0 mg/in$^2$ 0.46 mg/cm$^2$), or between about 0.1 mg/in$^2$ (0.02 mg/cm$^2$) to about 5.0 mg/in$^2$ (0.78 mg/cm$^2$) of the mold release agent is present per unit area of the mold when a mold release is desired. In some embodiments, the top surface of the mold is coated with the alpha alumina precursor dispersion. The alpha alumina precursor dispersion can be pumped onto the top surface.

Next, a scraper or leveler bar can be used to force the alpha alumina precursor dispersion fully into the cavity of the mold. The remaining portion of the alpha alumina precursor dispersion that does not enter cavity can be removed from top surface of the mold and recycled. In some embodiments, a small portion of the alpha alumina precursor dispersion can remain on the top surface and in other embodiments the top surface is substantially free of the dispersion. The pressure applied by the scraper or leveler bar is typically less than 100 psi (0.7 MPa), less than 50 psi (0.3 MPa), or even less than 10 psi (69 kPa). In some embodiments, no exposed surface of the alpha alumina precursor dispersion extends substantially beyond the top surface to ensure uniformity in thickness of the resulting ceramic shaped abrasive particles.

The fourth process step involves removing the volatile component to dry the dispersion. Desirably, the volatile component is removed by fast evaporation rates. In some embodiments, removal of the volatile component by evaporation occurs at temperatures above the boiling point of the volatile component. An upper limit to the drying temperature often depends on the material the mold is made from. For polypropylene tooling the temperature should be less than the melting point of the plastic. In one embodiment, for a water dispersion of between about 40 to 50 percent solids and a polypropylene mold, the drying temperatures can be between about 90° C. to about 165° C., or between about 105° C. to about 150° C., or between about 105° C. to about 120° C. Higher temperatures can lead to improved production speeds but can also lead to degradation of the polypropylene tooling limiting its useful life as a mold.

The fifth process step involves removing resultant precursor ceramic shaped abrasive particles with from the mold cavities. The precursor ceramic shaped abrasive particles can be removed from the cavities by using the following processes alone or in combination on the mold: gravity, vibration, ultrasonic vibration, vacuum, or pressurized air to remove the particles from the mold cavities.

The precursor abrasive particles can be further dried outside of the mold. If the alpha alumina precursor dispersion is dried to the desired level in the mold, this additional drying step is not necessary. However, in some instances it may be economical to employ this additional drying step to minimize the time that the alpha alumina precursor dispersion resides in the mold. Typically, the precursor ceramic shaped abrasive particles will be dried from 10 to 480 minutes, or from 120 to 400 minutes, at a temperature from 50° C. to 160° C., or at 120° C. to 150° C.

The sixth process step involves calcining the precursor ceramic shaped abrasive particles. During calcining, essentially all the volatile material is removed, and the various components that were present in the alpha alumina precursor dispersion are transformed into metal oxides. The precursor ceramic shaped abrasive particles are generally heated to a temperature from 400° C. to 800° C., and maintained within this temperature range until the free water and over 90 percent by weight of any bound volatile material are removed. In an optional step, it may be desired to introduce the modifying additive by an impregnation process. A water-soluble salt can be introduced by impregnation into the pores of the calcined, precursor ceramic shaped abrasive particles. Then the precursor ceramic shaped abrasive particles are pre-fired again. This option is further described in U.S. Pat. No. 5,164,348 (Wood).

The seventh process step involves sintering the calcined, precursor ceramic shaped abrasive particles to form alpha alumina particles. Prior to sintering, the calcined, precursor ceramic shaped abrasive particles are not completely densified and thus lack the desired hardness to be used as ceramic shaped abrasive particles. Sintering takes place by heating the calcined, precursor ceramic shaped abrasive particles to a temperature of from 1,000° C. to 1,650° C. and maintaining them within this temperature range until substantially all of the alpha alumina monohydrate (or equivalent) is converted to alpha alumina and the porosity is reduced to less than 15 percent by volume. The length of time to which the calcined, precursor ceramic shaped abrasive particles must be exposed to the sintering temperature to achieve this level of conversion depends upon various factors but usually from five seconds to 48 hours is typical.

The duration for the sintering step may range, for example, from one minute to 90 minutes. After sintering, the ceramic shaped abrasive particles can have a Vickers hardness of 10 gigapascals (GPa), 16 GPa, 18 GPa, 20 GPa, or greater.

Other steps can be used to modify the described process such as, for example, rapidly heating the material from the calcining temperature to the sintering temperature, centrifuging the alpha alumina precursor dispersion to remove sludge and/or waste. Moreover, the process can be modified by combining two or more of the process steps if desired. Conventional process steps that can be used to modify the process of this disclosure are more fully described in U.S. Pat. No. 4,314,827 (Leitheiser).

More information concerning methods to make ceramic shaped abrasive particles is disclosed in co-pending U.S. Publ. Patent Appln. No. 2009/0165394 A1 (Culler et al.).

Although there is no particularly limitation on the shape of the ceramic shaped abrasive particles, the abrasive particles are preferably formed into a predetermined shape, e.g. by shaping precursor particles comprising a ceramic precursor material (e.g., a boehmite sol-gel) using a mold, followed by sintering. The ceramic shaped abrasive particles may be shaped as, for example, pillars pyramids, truncated pyramids (e.g., truncated triangular pyramids), and/or some other regular or irregular polygons. The abrasive particles may include a single kind of abrasive particles or an abrasive aggregate formed by two or more kinds of abrasive or an abrasive mixture of two or more kind of abrasives. In some embodiments, the ceramic shaped abrasive particles are precisely-shaped in that individual ceramic shaped abrasive particles will have a shape that is essentially the shape of the portion of the cavity of a mold or production tool in which the particle precursor was dried, prior to optional calcining and sintering.

Figure 3A:
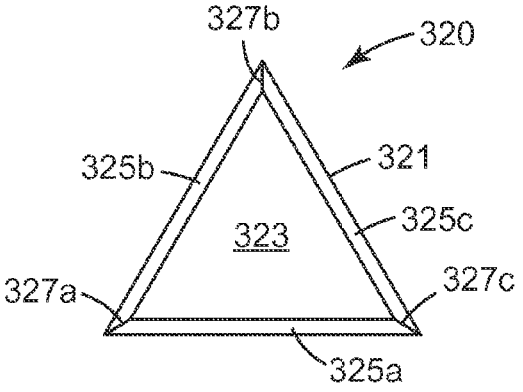
FIG. 3A is a schematic top view of exemplary ceramic shaped abrasive particle 320.
Figure 3B:
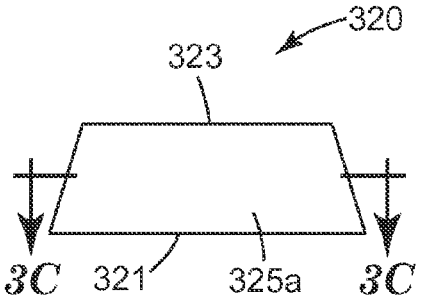
FIG. 3B is a schematic side view of exemplary ceramic shaped abrasive particle 320.
Figure 3C:
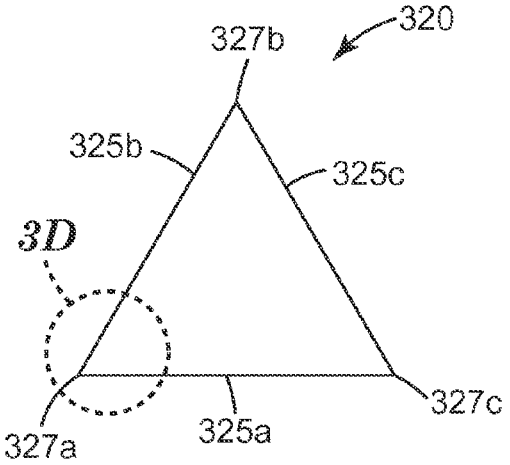
FIG. 3C is a cross-sectional top view of plane 3-3 in FIG. 3B.
Figure 3D:
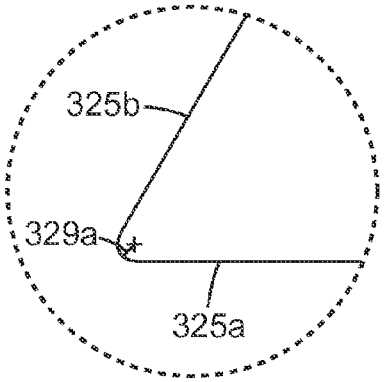
FIG. 3D is an enlarged view of side edge 327*a* in FIG. 3C.

FIGS. 3A-3B show an exemplary useful; ceramic shaped abrasive particle 320 bounded by a trigonal base 321, a trigonal top 323, and plurality of sides 325*a*, 325*b*, 325*c* connecting base 321 and top 323. In some embodiments, base 321 has side edges 327*a*, 327*b*, 327*c*, having an average radius of curvature of less than 50 micrometers. FIGS. 3C-3D show radius of curvature 329*a* for side edge 327*a*. In general, the smaller the radius of curvature, the sharper the side edge will be.

In some embodiments, ceramic shaped abrasive particles may have a radius of curvature along the side edges connecting the base and top of the ceramic shaped abrasive particles of 50 micrometers or less. The radius of curvature can be measured from a polished cross-section taken between the top and bottom surfaces, for example, using a CLEMEX VISION PE image analysis program available from Clemex Technologies, Inc. of Longueuil, Quebec, Canada, interfaced with an inverted light microscope, or other suitable image analysis software/equipment. The radius of curvature for each point of the shaped abrasive particle can be determined by defining three points at the tip of each point when viewed in cross-section (e.g., at 100× magnification). The first point is placed at the start of the tip's curve where there is a transition from the straight edge to the start of a curve, the second point is located at the apex of the tip, and the third point at the transition from the curved tip back to a straight edge. The image analysis software then draws an arc defined by the three points (start, middle, and end of the curve) and calculates a radius of curvature. The radius of curvature for at least 30 apexes are measured and averaged to determine the average tip radius.

Ceramic shaped abrasive particles used in the present disclosure can typically be made using tools (i.e., molds) cut using diamond tooling, which provides higher feature definition than other fabrication alternatives such as, for example, stamping or punching. Typically, the cavities in the tool surface have planar faces that meet along sharp edges, and form the sides and top of a truncated pyramid. The resultant ceramic shaped abrasive particles have a respective nominal average shape that corresponds to the shape of cavities (e.g., truncated pyramid) in the tool surface; however, variations (e.g., random variations) from the nominal average shape may occur during manufacture, and ceramic shaped abrasive particles exhibiting such variations are included within the definition of ceramic shaped abrasive particles as used herein.

In some embodiments, the base and the top of the ceramic shaped abrasive particles are substantially parallel, resulting in prismatic or truncated pyramidal (as shown in FIGS. 3A-3B) shapes, although this is not a requirement. As shown, sides 325*a*, 325*b*, 325*c* have equal dimensions and form dihedral angles with base 321 of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As used herein in referring to ceramic shaped abrasive particles, the term "length" refers to the maximum dimension of a shaped abrasive particle. "Width" refers to the maximum dimension of the shaped abrasive particle that is perpendicular to the length. The terms "thickness" or "height" refer to the dimension of the shaped abrasive particle that is perpendicular to the length and width.

The ceramic shaped abrasive particles are typically selected to have a length in a range of from 0.1 micron to 1600 microns, more typically 10 microns to about 1000 microns, and still more typically from 150 to 800 microns, although other lengths may also be used. In some embodiments, the length may be expressed as a fraction of the thickness of the bonded abrasive wheel in which it is contained. For example, the shaped abrasive particle may have a length greater than half the thickness of the bonded abrasive wheel. In some embodiments, the length may be greater than the thickness of the bonded abrasive cut-off wheel.

The ceramic shaped abrasive particles are typically selected to have a width in a range of from 0.001 mm to 26 mm, more typically 0.1 mm to 10 mm, and more typically 0.5 mm to 5 mm, although other lengths may also be used.

The ceramic shaped abrasive particles are typically selected to have a thickness in a range of from 0.005 mm to 10 mm, more typically from 0.2 to 1.2 mm.

In some embodiments, the ceramic shaped abrasive particles may have an aspect ratio (length to thickness) of at least 2, 3, 4, 5, 6, or more.

Surface coatings on the ceramic shaped abrasive particles may be used to improve the adhesion between the ceramic shaped abrasive particles and a binder in abrasive articles, or can be used to aid in electrostatic deposition of the ceramic shaped abrasive particles. In one embodiment, surface coatings as described in U.S. Pat. No. 5,352,254 (Celikkaya) in an amount of 0.1 to 2 percent surface coating to shaped abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the ceramic shaped abrasive particles. Surface coatings to perform the above functions are known to those of skill in the art.

The bonded abrasive wheel may further comprise additional abrasive particles, which may be crushed (i.e., abrasive particles not resulting from breakage of the ceramic shaped abrasive particles and corresponding to an abrasive industry specified nominal graded or combination thereof). The crushed abrasive particles are typically of a finer size grade or grades (e.g., if a plurality of size grades are used) than the ceramic shaped abrasive particles, although this is not a requirement.

Useful additional abrasive particles include, for example, particles of fused aluminum oxide, heat treated aluminum oxide, white fused aluminum oxide, ceramic aluminum oxide materials such as those commercially available under the trade designation 3M CERAMIC ABRASIVE GRAIN from 3M Company of St. Paul, Minn., brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, sol-gel derived abrasive particles, iron oxide, chromia, ceria, zirconia, titania, silicates, tin oxide, silica (such as quartz, glass beads, glass bubbles and glass fibers) silicates (such as talc, clays (e.g., montmorillonite), feldspar, mica, calcium silicate, calcium metasilicate, sodium aluminosilicate, sodium silicate), flint, emery, and combinations thereof. Examples of sol-gel derived abrasive particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the abrasive particles to the binder. The abrasive particles may be treated before combining them with the binder, or they may be surface treated in situ by including a coupling agent to the binder.

Typically, conventional crushed abrasive particles are independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000

More typically, the crushed aluminum oxide particles and the non-seeded sol-gel derived alumina-based abrasive particles are independently sized to ANSI 60 and 80, or FEPA F16, F20, F24, F30, F36, F46, F54 and F60 grading standards. According to an embodiment of the present invention, the average diameter of the abrasive particles may be within a range of from 260 to 1400 microns in accordance with FEPA grades F60 to F24.

Alternatively, ceramic shaped abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the ceramic shaped abrasive particles pass through a test sieve meeting ASTM E-11 specifications for the number 18 sieve and are retained on a test sieve meeting ASTM E-11 specifications for the number 20 sieve. In one embodiment, the ceramic shaped abrasive particles have a particle size such that most of the particles pass through an 18 mesh test sieve and can be retained on a 20, 25, 30, 35, 40, 45, or 50 mesh test sieve. In various embodiments, the ceramic shaped abrasive particles can have a nominal screened grade of: −18+20, −20/+25, −25+30, −30+35, −35+40, −40+45, −45+50, −50+60, −60+70, −701+80, −80+100, −100+120, −120+140, −140+170, −170+200, −200+230, −230+270, −270+325, −325+400, −400+450, −450+500, or −500+635. Alternatively, a custom mesh size can be used such as −90+100. The total amount of abrasive particles (ceramic shaped abrasive particles plus any other abrasive particles) in the bonded abrasive wheel is preferably in an amount of from 35 percent by weight to 80 percent by weight, based on the total weight of the bonded abrasive wheel.

The abrasive particles may, for example, be uniformly or non-uniformly distributed throughout the bonded abrasive article. For example, the abrasive particles may be concentrated toward the outer edge (i.e., the periphery), of the cut-off wheel. A center portion may contain a lesser amount of abrasive particles. In another variation, first abrasive particles may be in the sides of the wheel with different abrasive particles in the center. However, typically all the abrasive particles are homogenously distributed among each other, because the manufacture of the wheels is easier, and the cutting effect is optimized when the two types of abrasive particles are closely positioned to each other.

The bonded abrasive wheels may contain additional grinding aids such as, for example, polytetrafluoroethylene particles, graphite, molybdenum sulfide, cryolite, sodium chloride, potassium chloride, $FeS_2$ (iron disulfide), zinc sulfide, or $KBF_4$; typically in amounts of from 1 to 25 percent by weight, more typically 10 to 20 percent by weight, subject to weight range requirements of the other constituents being met. Grinding aids are added to improve the cutting characteristics of the cut-off wheel, generally resulting in reducing the temperature of the cutting interface. The grinding aid may be in the form of single particles or an agglomerate of grinding aid particles. Examples of precisely-shaped grinding aid particles are taught in U.S. Patent Publ. No. 2002/0026752 A1 (Culler et al.).

In some embodiments, the binder contains plasticizer such as, for example, that available as SANTICIZER 154 PLASTICIZER from UNIVAR USA, Inc. of Chicago, Ill.

The bonded abrasive wheels may contain additional components such as, for example, filler particles, subject to weight range requirements of the other constituents being met. Filler particles may be added to occupy space and/or provide porosity. Porosity enables the bonded abrasive wheel to shed used or worn abrasive particles to expose new or fresh abrasive particles. Examples of fillers include bubbles and beads (e.g., glass, ceramic (alumina), clay, polymeric, metal), calcite, metal carbonates, gypsum, marble, limestone, flint, silica, silicates (e.g., aluminum silicate), metal sulfates, metal sulfides, metal oxides, metal such as tin or aluminum, and metal sulfites as well as metal halogen compound. The filler can support the cutting ability and performance of the cutting wheel reducing friction, wear and apparent temperature in the grinding zone. The filler may be used alone or in combination in a range of from about 1 to 60 percent by weight, preferably in the range of from 20 to 40 percent by weight, based on the total weight of the binder. The particle size, which may vary with the type of filler, usually has a size in a range of from 1 to 150 microns.

The bonded abrasive wheels may have any range of porosity; for example, from less than 1 percent to 50 percent, typically 1 percent to 40 percent by volume.

The bonded abrasive wheels can be made according to any suitable method. In one suitable method, the non-seeded sol-gel derived alumina-based abrasive particles are coated with a coupling agent prior to mixing with a curable resole phenolic resin. The amount of coupling agent is generally selected such that it is present in an amount of 0.1 to 0.3 parts for every 50 to 84 parts of abrasive particles, although amounts outside this range may also be used. To the resulting mixture is added the liquid resin, as well as the curable novolac phenolic resin and cryolite. The mixture is pressed into a mold (e.g., at an applied pressure of 20 tons per 4 inches diameter (224 kg/cm$^2$) at room temperature or elevated temperature. The molded wheel is then cured by heating at temperatures up to about 185° C. for sufficient time to cure the curable phenolic resins.

Coupling agents are well-known to those of skill in the abrasive arts. Examples of coupling agents include trialkoxysilanes (e.g., gamma-aminopropyltriethoxysilane), titanates, and zirconates.

Useful bonded abrasive wheels include, for example, cut-off wheels and abrasives industry Type 27 (e.g., as in American National Standards Institute standard ANSI B7.1-2000 (2000) in section 1.4.14) depressed-center grinding and cut-off wheels.

An optional center hole may be used to attaching the bonded abrasive wheel to a power driven tool, including stationary machine tools. If present, the center hole, which may be round or some other shape, is typically 5 mm to 25 mm or larger in cross-section diameter, although other sizes may be used. The center hole is typically about one tenth the diameter of the bonded abrasive wheel. The optional center hole may be reinforced; for example, by a metal flange. In some cases, the abrasive wheel may have a steel core with an outer bonded abrasive ring.

In some embodiments, the bonded abrasive wheel may have a diameter of at least 150 millimeters (mm), 200 mm, 230 mm, 260 mm, 350 mm, 400 mm, 500 mm, 800 mm, 1000 mm, 1200 mm, 1500 mm, 2000 mm or even at least 2500 mm.

Optionally, bonded abrasive wheels, and especially cut-off wheels, used in methods according to the present disclosure may further comprise a scrim or other reinforcing material (e.g., paper, nonwoven, knitted, or woven material) that reinforces the bonded abrasive wheel; for example, disposed on one or two major surfaces of the bonded abrasive wheel, or disposed within the bonded abrasive wheel. Examples of reinforcing materials include woven or knitted cloth or scrim. The fibers in the reinforcing material may be made from glass fibers (e.g., fiberglass), carbon fibers, and organic fibers such as polyamide, polyester, or polyimide. In some instances, it may be desirable to include reinforcing staple fibers within the bonding medium, so that the fibers are homogeneously dispersed throughout the cut-off wheel.

Reinforcing fibers may be added to the bonded abrasive wheel to improve stability and/or safety of the bonded abrasive wheel. They may include glass fibers which are impregnated with resin, preferably phenolic resin. The position can be on the outside of both sides, and/or in the inner part of the wheel. The number of reinforcements depends on the application of the bonded abrasive wheel.

High-power stationary machines are suitable for practice of the present disclosure. Examples include machines available from Danieli & Cia Officine Meccaniche SPA, Buttrio, Italy; Braun Maschinenfabrik, Vöcklabruck, Austria; and Siemens VAI Metals Technologies S.r.l. (Pomini), Marnate, Italy. The motor can be electrically, hydraulically, or pneumatically driven, generally at speeds from about 1000 to 50000 revolutions per minute (rpm). In some embodiments, the peripheral work surface of the bonded abrasive wheel rotates at a speed of at least 30 meters per second (m/sec), at least 60 msec, or even at least 80 msec.

Methods of abrading a workpiece according to the present disclosure can be practiced, for example, dry or wet and/or hot or cold as desired. During wet processes, the bonded abrasive wheel is used in conjunction with water, oil-based lubricants, or water-based lubricants. Bonded abrasive wheels according to the present disclosure may be particularly useful on various workpiece materials such as, for example, high carbon or low carbon steel sheet or bar stock, and more exotic metals (e.g., stainless steel or titanium), or on softer more ferrous metals (e.g., mild steel, low alloy steels, or cast irons).

Advantageously, methods according to the present disclosure can be practiced are higher than conventional cut rates. For example, in some embodiments, the workpiece and rotating bonded abrasive wheel may be urged against one another to achieve a cut rate of at least 20 square centimeters per second (cm$^2$/sec), 45 cm$^2$/sec, 50 cm$^2$/sec, 50 cm$^2$/sec, or even at least 60 cm$^2$/sec.

The swarf resulting from methods according to the present disclosure includes filamentary swarf, and may optionally include other non-filamentary components. That is, filamentary swarf may represent all, or more typically less than the total amount of swarf that is generated. In aggregate, the filamentary swarf may resemble steel wool. In some embodiments, at least a portion of the filamentary swarf may have a length of at least 3 millimeters (mm), at least 10 mm, at least 15 mm, at least 20 mm, or even at least 25 mm. In some embodiments, at least a portion of the filamentary swarf may have an aspect ratio (length divided by width) of at least 5, 10, 20, 50, or even 100.

Without wishing to be bound by theory, it is believed that the cutting performance of the bonded abrasive articles useful in the present disclosure may be due to self-sharpening fracturing of the ceramic shaped abrasive particles during use.

Also, in practice of the present disclosure, the G-ratio is typically improved relative to comparable conventional bonded abrasive wheels having only crushed abrasive grain of the same composition in place of the ceramic shaped abrasive grain, resulting in a longer service life. In some embodiments, the G-ratio is at least 2, 2.5, or even 3.

SELECT EMBODIMENTS OF THE PRESENT DISCLOSURE

In a first embodiment, the present disclosure provides a method of abrading a workpiece, the method comprising:

providing a stationary rotating bonded abrasive wheel having a diameter of at least 150 millimeters, wherein the bonded abrasive wheel comprises ceramic shaped abrasive particles retained in a binder; and contacting the rotating bonded abrasive wheel with a metallic workpiece such that the workpiece is abraded with simultaneous formation of metallic swarf, wherein the metallic workpiece has a bulk temperature of less than 500° C., and wherein at least 20 percent by weight of the metallic swarf is filamentary metallic swarf having a length of at least 3 millimeters.

In a second embodiment, the present disclosure provides a method according to the first embodiment, wherein at least 20 percent by weight of the metallic swarf is filamentary metallic swarf having a length of at least 10 millimeters.

In a third embodiment, the present disclosure provides a method according to the first or second embodiment, wherein the rotating bonded abrasive wheel further comprises crushed abrasive particles.

In a fourth embodiment, the present disclosure provides a method according to any of the first to third embodiments, wherein the binder comprises a cured organic binder resin.

In a fifth embodiment, the present disclosure provides a method according to any of the first to fourth embodiments, wherein the rotating bonded abrasive wheel has a diameter of at least 350 millimeters.

In a sixth embodiment, the present disclosure provides a method according to any of the first to fifth embodiments, wherein the workpiece and rotating bonded abrasive wheel are urged against one another to achieve a cut rate of at least 20 $cm^2$/sec.

In a seventh embodiment, the present disclosure provides a method according to any of the first to sixth embodiments, wherein the workpiece and rotating bonded abrasive wheel are urged against one another to achieve a cut rate of at least 40 $cm^2$/sec.

In an eighth embodiment, the present disclosure provides a method according to any of the first to seventh embodiments, wherein the ceramic shaped abrasive particles are precisely-shaped.

In a ninth embodiment, the present disclosure provides a method according to any of the first to eighth embodiments, wherein the ceramic shaped abrasive particles comprise truncated triangular pyramids.

In a tenth embodiment, the present disclosure provides a method according to any of the first to ninth embodiments, wherein the ceramic shaped abrasive particles comprise alpha alumina.

In an eleventh embodiment, the present disclosure provides a method according to any of the first to tenth embodiments, wherein the workpiece comprises steel.

In a twelfth embodiment, the present disclosure provides a method according to any of the first to eleventh embodiments, wherein the rotating bonded abrasive wheel has a diameter of at least 1000 millimeters.

In a thirteenth embodiment, the present disclosure provides a method according to any of the first to twelfth embodiments, wherein the rotating bonded abrasive wheel has a peripheral work surface that rotates at a speed of at least 20 meters/second.

In a fourteenth embodiment, the present disclosure provides a method according to any of the first to thirteenth embodiments, wherein, for cold cutting conditions, the G-ratio is at least 3.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. The abbreviation "pbw" refers to parts by weight.

Preparation of REO-Doped Ceramic Shaped Abrasive Particles (SAP1)

A sample of boehmite sol-gel was made using the following recipe: aluminum oxide monohydrate powder (1600 parts) available as DISPERAL from Sasol North America, Inc. was dispersed by high shear mixing a solution containing water (2400 parts) and 70 percent aqueous nitric acid (72 parts) for 11 minutes. The resulting sol-gel was aged for at least 1 hour before coating. The sol-gel was forced into production tooling having triangular-shaped mold cavities of dimensions: 2.79 mm×0.762 mm, 98° slope angle.

The sol-gel was forced into the cavities with a putty knife so that the openings of the production tooling were completely filled. A mold release agent, 1 percent peanut oil in methanol was used to coat the production tooling with about 0.5 mg/$in^2$ (0.08 mg/$cm^2$) of peanut oil applied to the production tooling. The excess methanol was removed by placing sheets of the production tooling in an air convection oven for 5 minutes at 45° C. The sol-gel coated production tooling was placed in an air convection oven at 45° C. for at least 45 minutes to dry. The precursor ceramic shaped abrasive particles were removed from the production tooling by passing it over an ultrasonic horn. The precursor ceramic shaped abrasive particles were calcined at approximately 650° C. and then saturated with a with a mixed nitrate solution of MgO, $Y_2O_3$, CoO and $La_2O_3$.

The ceramic shaped abrasive particles were treated to enhance electrostatic application of the ceramic shaped abrasive particles in a manner similar to the method used to make crushed abrasive particles as disclosed in U.S. Pat. No. 5,352,254 (Celikkaya). The calcined, precursor ceramic shaped abrasive particles were impregnated with an alternative rare earth oxide (REO) solution comprising 1.4 percent MgO, 1.7 percent $Y_2O_3$, 5.7 percent $La_2O_3$ and 0.07 percent CoO. Into 70 grams of the REO solution, 1.4 grams of HYDRAL COAT 5 powder available from Almatis of Pittsburgh, Pa. (approximately 0.5 micron mean particle size) was dispersed by stirring it in an open beaker. About 100 grams of calcined, precursor ceramic shaped abrasive particles was then impregnated with the 71.4 grams of the HYDRAL COAT 5 powder dispersion in REO solution. The excess nitrate solution was removed and the saturated precursor ceramic shaped abrasive particles were allowed to dry after which the particles were again calcined at 650° C. and sintered at approximately 1400° C. Both the calcining and sintering were carried out using rotary tube kilns. The resulting composition was an alumina composition containing 1 weight percent MgO, 1.2 weight percent of $Y_2O_3$, 4 weight percent of $La_2O_3$ and 0.05 weight percent of CoO, with traces of $TiO_2$, $SiO_2$, and CaO. The resulting ceramic shaped abrasive particles had the following characteristics: average particle length=1.384 mm (Std. Dev.=0.055 mm), average particle thickness=0.229 mm (Std. Dev.=0.026 mm), average particle aspect ratio=6.0, average radius of curvature of abrasive particle side edges 12.71 microns (St. Dev.=7.44 microns).

Example 1

The following composition was prepared: SAP1 (70.8 pbw) of ceramic shaped abrasive particles was mixed with 5.05 pbw of PREFERE 825174 liquid phenolic resin from Dynea OY, Helsinki, Finland. The mixture was mixed for 5 minutes to cover the grain with the liquid resin.

A binder mixture was prepared by combining: 5.9 pbw of PREFERE 828528 phenolic powder resin from Dynea OY; 1.5 pbw of SUPRAPLAST 1014 M phenolic powder resin from Süd-West-Chemie GmbH, Neu-Ulm, Germany; 1.44 pbw phenolic powder resin BOROFEN BL 15/02 from Fenolit d.d., Borovnica, Slovenia; 5.03 pbw of TRIBOTEC PYROX red filler from Chemetall, Vienna, Austria; 5.03 pbw of potassium aluminum fluoride from company KBM Affilips, Oss, The Netherlands; and 4.47 pbw of TRIBOTEC GWZ 100 from Chemetall. The binder mixture and the abrasive with the liquid resin coated were mixed together for 5 minutes. After mixing, they were sieved through a sieve mesh, size 24.

Into a mold was placed a glass fiber woven reinforcement having a basis weight between 200 and 400 g/cm$^2$. The mold was then filled with 1157 grams of the mix above. A second piece of the reinforcing scrim was placed on the upper side of the mix. The mold was closed and kept under pressure of 500 metric tons for several seconds. The pressed wheel was transferred to a metal plate, and put into an oven for curing for 28 hours at temperatures of up to 180° C. The resultant wheel had a thickness of 4.4 mm, a diameter of 400 mm, and a 40 mm diameter center hole.

After curing, the resultant wheel was tested for cutting. The test was performed using a Trennblitz SAH520LAB stationary cut-off machine from Hülsmetall, Kamen, Germany, operating at a peripheral work surface speed of 63 meters/second under wet conditions. Coolant was water at room temperature. The test was performed in the cut-off operation on hardened carbon tool steel (material number 1.2842) with dimensions 45×35 mm in rectangular cross section. Cutting time was measured as 6 to 7 sec. The sparks observed during cutting were extremely long compared to the sparks from standard wheels.

Figure 4:
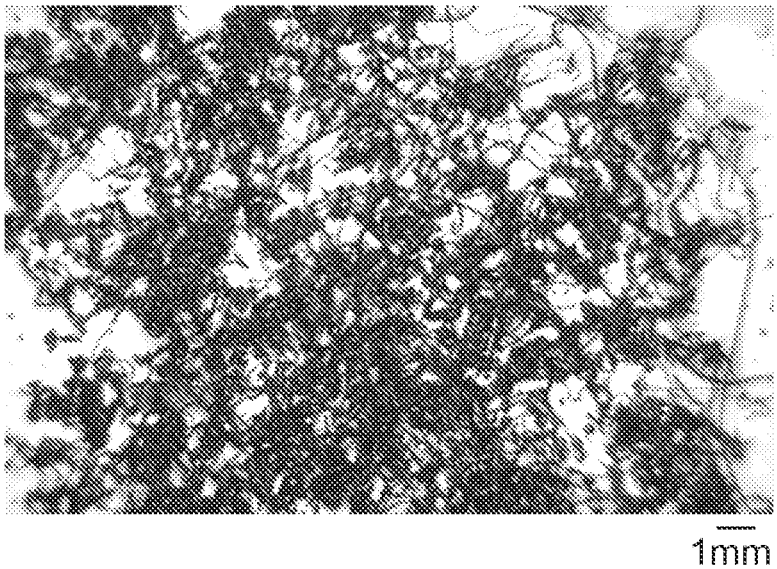
FIG. 4 is an optical photomicrograph of metallic swarf resulting of Example 1 cutting ST52 steel under wet conditions.

Swarf from testing was collected and dried, and is shown in FIG. 4. The dry weight of the swarf sample was 0.307 grams. Filamentary swarf greater than 3 mm in length was manually separated from the sample using a low power microscope using a vacuum needle. This material weighed 0.0821 grams or 26.7% of the weight of the total swarf sample.

Comparative Examples A-B

The following three compositions were prepared:

As a reference grain composition, 82.8 pbw white aluminum oxide in grit size 54 was used.

The second abrasive grain composition consisted of 41.4 pbw of SAP1 ceramic shaped abrasive particles (prepared above) and 41.4 pbw of crushed white aluminum oxide in grit size FEPA F54.

The three abrasive grain compositions were individually mixed with 3.1 pbw of PREFERE 825174 liquid phenolic resin. The mixtures were mixed for 5 minutes to cover the grain with the liquid resin.

A binder mixture of 5.5 pbw of PREFERE 828286 phenolic powder resin and 2.76 pbw PREFERE 828281 phenolic powder resin, both from Dynea OY, and 5.5 pbw of frit 90263 from Ferro Corp., Cleveland, Ohio, was added to each abrasive grain composition. The binder mixes and the abrasive mixtures with the liquid resin coated were mixed together for 5 minutes. After mixing, they were sieved through a sieve mesh, size 24.

Into separate molds were placed a glass fiber woven reinforcement having a basis weight between 200 and 400 g/cm$^2$. The molds were then separately filled with 901 grams of a different one of the three mixes above. A second piece of the reinforcing scrim was placed on the upper side of the mix. The molds were closed and kept under pressure of 500 metric tons for several seconds. The pressed wheels were transferred to a metal plate, and put into an oven for curing for 28 hours at temperatures of up to 180° C. The resultant wheels had a thickness of 3.5 mm and a diameter of 400 mm.

After curing, the resultant wheels (having dimensions 400 mm outer diameter×3.5 mm thickness×40 mm diameter center hole) were tested for cutting. The test was performed using a Trennblitz SAH520LAB stationary cut-off machine from Hülsmetall, Kamen, Germany, operating at a peripheral work surface speed of 80 meters/second under wet conditions. Coolant was water at room temperature. Cutting time was measured as 6 sec. in full cut for all cuts. The G-Ratio was calculated as an index for the lifetime of the cut-off wheel. The specific cutting rate was 2 cm$^2$/sec.

The test was performed in the cut-off operation on two materials, one on construction steel ST52 (material number 1.0577) in angular L cross section with dimensions 50×50×5 mm, and the second one on hardened carbon tool steel (material number 1.2842) with dimensions 45×35 mm in rectangular cross section.

On construction steel ST52 the results are compared to the standard wheel with 82.8 pbw white aluminum oxide (Comparative Example A). The wheel containing the first abrasive grain composition (Comparative Example B) showed a 113 percent increase in service life as compared to the wheel with the reference abrasive grain composition. All cuts showed clean surfaces with little or no burs.

The second test series was done on hardened carbon tool steel. The G-Ratio of the wheel containing the first abrasive grain composition was increased by 8 percent relative to the wheel containing the reference abrasive grain composition. The G-Ratio of the wheel containing the first abrasive grain composition was increased by 362 percent relative to the wheel containing the reference abrasive grain composition. All cuts again showed clean surfaces with little or no burrs.

Comparative Testing

No formation of filamentary metallic swarf was observed following the procedures in Examples 1-21 or Comparative Examples A-M of PCT International Application No. PCT/US2011/025696, international filing date of Feb. 22, 2011.

All examples given herein are to be considered non-limiting unless otherwise indicated. Various modifications and alterations of this disclosure may be made by those skilled in the art without departing from the scope and spirit of this disclosure, and it should be understood that this disclosure is not to be unduly limited to the illustrative embodiments set forth herein.

What is claimed is:

1. A method of abrading a workpiece, the method comprising:

providing a rotating bonded abrasive wheel attached to a stationary machine tool, the rotating bonded abrasive wheel having a diameter of at least 150 millimeters, wherein the bonded abrasive wheel comprises ceramic shaped abrasive particles retained in a binder, wherein the ceramic shaped abrasive particles comprise alpha alumina, and wherein the ceramic shaped abrasive particles comprise precisely-shaped truncated triangular pyramids; and contacting the rotating bonded abrasive wheel with a metallic workpiece such that the workpiece is abraded with simultaneous formation of metallic swarf, wherein the metallic workpiece has a bulk temperature of less than 500° C., and wherein at least 20 percent by weight of the metallic swarf is filamentary metallic swarf having a length of at least 3 millimeters.

2. The method of claim 1, wherein at least 20 percent by weight of the metallic swarf is filamentary metallic swarf having a length of at least 10 millimeters.

3. The method of claim 1, wherein the rotating bonded abrasive wheel further comprises crushed abrasive particles.

4. The method of claim 1, wherein the binder comprises a cured organic binder resin.

5. The method of claim 1, wherein the rotating bonded abrasive wheel has a diameter of at least 350 millimeters.

6. The method of claim 1, wherein the workpiece and rotating bonded abrasive wheel are urged against one another to achieve a cut rate of at least 20 $cm^2$/sec.

7. The method of claim 1, wherein the workpiece and rotating bonded abrasive wheel are urged against one another to achieve a cut rate of at least 40 $cm^2$/sec.

8. The method of claim 1, wherein the workpiece comprises steel.

9. The method of claim 1, wherein the rotating bonded abrasive wheel has a diameter of at least 1000 millimeters.

10. The method of claim 1, wherein the rotating bonded abrasive wheel has a peripheral work surface that rotates at a speed of at least 20 meters/second.

11. The method of claim 1, wherein, for cold cutting conditions, the G-ratio is at least 3.

* * * * *